US012723851B2

(12) United States Patent
Brune

(10) Patent No.: US 12,723,851 B2
(45) Date of Patent: Sep. 1, 2026

(54) SWINGING TARGET DEVICE

(71) Applicant: Challenge Targets, LLC, Fort Thomas, KY (US)

(72) Inventor: Bradley T. Brune, Fort Thomas, KY (US)

(73) Assignee: Challenge Targets, LLC, Fort Thomas, KY (US)

( * ) Notice: Subject to any disclaimer, the term of this patent is extended or adjusted under 35 U.S.C. 154(b) by 340 days.

(21) Appl. No.: 18/421,021

(22) Filed: Jan. 24, 2024

(65) Prior Publication Data

US 2024/0263925 A1 Aug. 8, 2024

Related U.S. Application Data

(60) Provisional application No. 63/483,577, filed on Feb. 7, 2023.

(51) Int. Cl.
*F41J 9/02* (2006.01)
*F41J 1/10* (2006.01)

(52) U.S. Cl.
CPC .. *F41J 9/02* (2013.01); *F41J 1/10* (2013.01)

(58) Field of Classification Search
CPC ..... F41J 1/10; F41J 7/04; F41J 9/02
See application file for complete search history.

(56) References Cited

U.S. PATENT DOCUMENTS

| | | | | |
|---|---|---|---|---|
| 7,735,832 | B2 * | 6/2010 | Bliehall | F41J 7/06 273/369 |
| 2011/0163503 | A1 * | 7/2011 | Townsend | F41J 7/04 273/355 |
| 2015/0276356 | A1 * | 10/2015 | Cesternino | F41J 1/10 273/370 |
| 2018/0087881 | A1 * | 3/2018 | Bickel | F41J 7/04 |
| 2021/0102787 | A1 * | 4/2021 | Howell | F41J 1/10 |

OTHER PUBLICATIONS

"Challenge Targets Propeller Texas Star (aka Irish Plate Rack)," uploaded to YouTube Jan. 4, 2019, available on the internet via URL https://www.youtube.com/watch?v=AqPTb3RQCwl (Year: 2019).*
<https://www.youtube.com/watch?v=g9tBlc0n3sA&t=92s>.
<https://www.challengetargets.com/product/CT-SWINGER.html>.
<https://www.youtube.com/watch?v=rWkMWRGPFu8>.

* cited by examiner

*Primary Examiner* — Audrey B. Walter
(74) *Attorney, Agent, or Firm* — Wood Herron & Evans LLP

(57) ABSTRACT

A swinging target device has a stand, an arm having a first end and a second end and pivoted to the stand between the first and second ends for pivoting movement about a primary pivot axis. A first target assembly is pivoted to the first end of the arm for pivoting movement about a first secondary pivot axis, and a second target assembly is pivoted to the second end of the arm for pivoting movement about a second secondary pivot axis.

11 Claims, 8 Drawing Sheets

SWINGING TARGET DEVICE

RELATED APPLICATIONS

This application claims priority to U.S. Patent Application No. 63/483,577, filed Feb. 7, 2023, and incorporates the same by reference herein.

TECHNICAL FIELD

This invention relates to a device that provides a moving target at which projectiles are shot. The device includes multiple, relative pivot points about which targets with moving and/or changeable centers of mass can rotate.

BACKGROUND

Shooting for fun or competition benefits from accuracy. The level of difficulty is increased when the target is moving, and even more so when the target is moving in multiple and seemingly unpredictable directions.

Bobbing targets produce up and down (vertical) movement along one axis. Swinging pendulum targets produce both up and down (vertical) and side-to-side (horizontal) movement in two directions. In competition and training, shooters will try to time a moving target and shoot it at the stopping point when it changes or reverses direction. In real life, it may be impossible to predict the stopping point of a target, so making the movement of the target mechanism less predictable is a significant challenge and training benefit.

Accomplishing this movement with no power source, using only gravity and mechanical components, is a significant benefit to range management who prefer simplicity and durability in the harsh outdoor environments where this type of training is commonly conducted. Movement can be initiated by releasing the target mechanism from a position of potential energy. One part of a swinging mechanism can be propped up and then released manually or by shooting away the prop. Also, movement of a static target device can be initiated by changing the center of mass of a rotating or swinging target, such as by removing or shooting away a target plate or part that acts as a counterweight.

Reactive targets provide a visible, audible, and/or dynamic (movement) response. One type of reactive, moving target is commonly known as a "Texas Star." This is a device that has multiple (usually five) arms in an array that pivot around a fixed axis on a stand with a responsive target plate at the end of each arm. The device can be set into rotating motion manually or by "shooting off" one of the target plates. As used herein, "shooting off" or "shot off" refers to a projectile striking a target plate that is designed to dislocate from its support and fall to the ground as a result of the impact force. Such detachment mechanisms are well-known and allow the target plate to be reattached easily. When the Texas Star target array is balanced, it will spin freely around its fixed pivot axis. When the target array is unbalanced, it will swing about the pivot axis in a pendular motion.

When a metallic target plate is stuck, it produces a sound and falls off the arm to the ground. Because the targets plates are usually made of hardened steel, they have substantial mass (weight) and the change in weight distribution (center of mass) causes the array of arms to rotate at a different speed and/or reverse direction. Thus, gravity and momentum drive the target device. Movement will slow by damping unless or until the weight distribution changes and the force of gravity again propels pendular movement.

SUMMARY OF THE INVENTION

In one aspect, a swinging target device comprises a stand, an arm having a first end and a second end, the arm pivoted to the stand between the first and second ends of the arm for pivoting movement about a primary pivot axis, the arm having a first arm portion extending from the primary pivot axis to the first end of the arm and having a second arm portion extending from the primary pivot axis to the send end of the arm, a first target assembly pivoted to the first end of the arm for pivoting movement about a first secondary pivot axis, and a second target assembly pivoted to the second end of the arm for pivoting movement about a second secondary pivot axis.

At least one of the first and second target assemblies can have a variable mass that changes when at least a portion of the one of the first and second target assemblies is struck by a projectile. When the mass of the one of the target assemblies changes, a center of gravity of the one of the target assemblies can also change.

One of the first and second target assemblies can be configured to oscillate +/−90 degrees from vertical and the other of the first and second target assemblies can be configured to rotate through 360 degrees.

The first target assembly can comprise a target frame extending upwardly from the first secondary pivot axis, a target panel mounted to the target frame, and a counterweight attached to the target frame and extending downwardly from the first secondary pivot axis. The second target assembly can comprise an arm assembly having at least three arms projecting radially outwardly from the second secondary pivot axis, and a target plate removably attached to a free end of each of the arms, the target plates configured to detach from respective arms when struck by a projectile.

The first and second arm portions can form an angle of 0 degrees to 180 degrees relative to one another. The first arm portion has a first length and the second arm portion has a second length. The first and second lengths can be the same or different.

A combined center of gravity of the arm and the first and second target assemblies can be coaxial with the primary pivot axis or not coaxial with the primary pivot axis.

In another aspect, a swinging target device comprises a stand, an arm having a first end and a second end, the arm pivoted to the stand between the first and second ends of the arm for pivoting movement about a primary pivot axis, a first target assembly pivoted to the first end of the arm for pivoting movement about a first secondary pivot axis, and a second target assembly pivoted to the second end of the arm for pivoting movement about a second secondary pivot axis. The first target assembly comprises a target frame extending upwardly from the first secondary pivot axis, a target panel mounted to the target frame, and a counterweight attached to the target frame and extending downwardly from the first secondary pivot axis, the first target assembly configured to oscillate +/−90 degrees from vertical. The second target assembly comprises an arm assembly having at least three arms projecting radially outwardly from the second secondary pivot axis, and a target plate removably attached to a free end of each of the arms, the target plates configured to detach from respective arms when struck by a projectile, the second target assembly configured to rotate through 360 degrees.

The target device herein thus causes the speed and direction of the targets to change as they swing or rotate in arcs with moving pivot points. This causes changing vertical, horizontal, and angular positions (at changing speed) according to multiple variables that affect each other.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWING FIGURES

Like reference numerals are used to indicate like parts throughout the various drawing figures, wherein.

DETAILED DESCRIPTION

Figure 1:
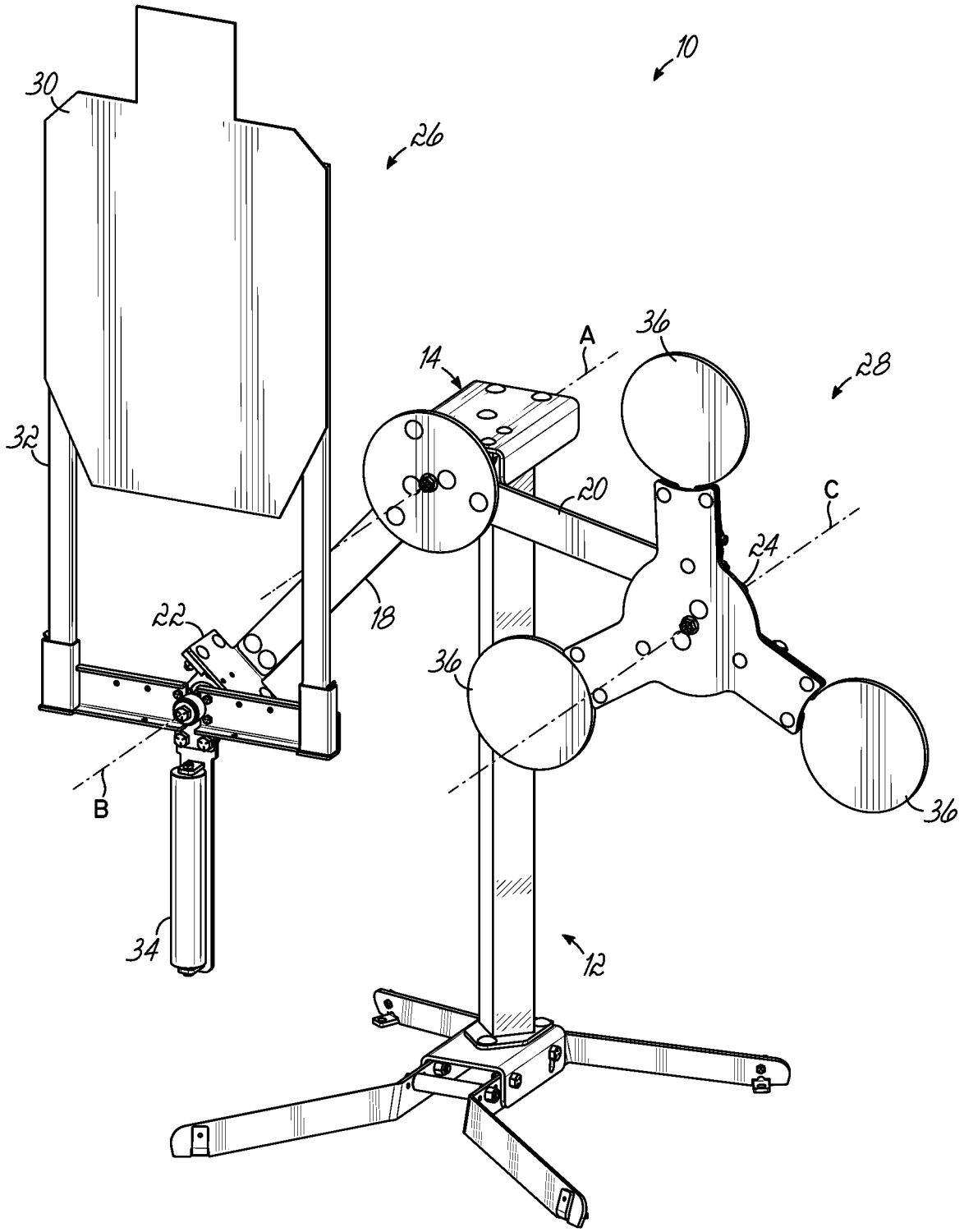
FIG. 1 is a pictorial view of a swinging target device according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction toward the shooter and the direction from which projectiles are fired, while "rearward" will indicate the opposite direction. "Lateral" or "transverse" indicates a side-to-side direction generally perpendicular to the axis of the support base or target. "Top" or "up" will be the upward direction relative to the ground and opposite the force of gravity while "bottom" or "down" will be the downward direction relative to the ground and in the direction of the force of gravity. As used herein, "substantially" means about or approximately, allowing for minor variation that does not detract from the construction or operation of the invention.

Figure 2:
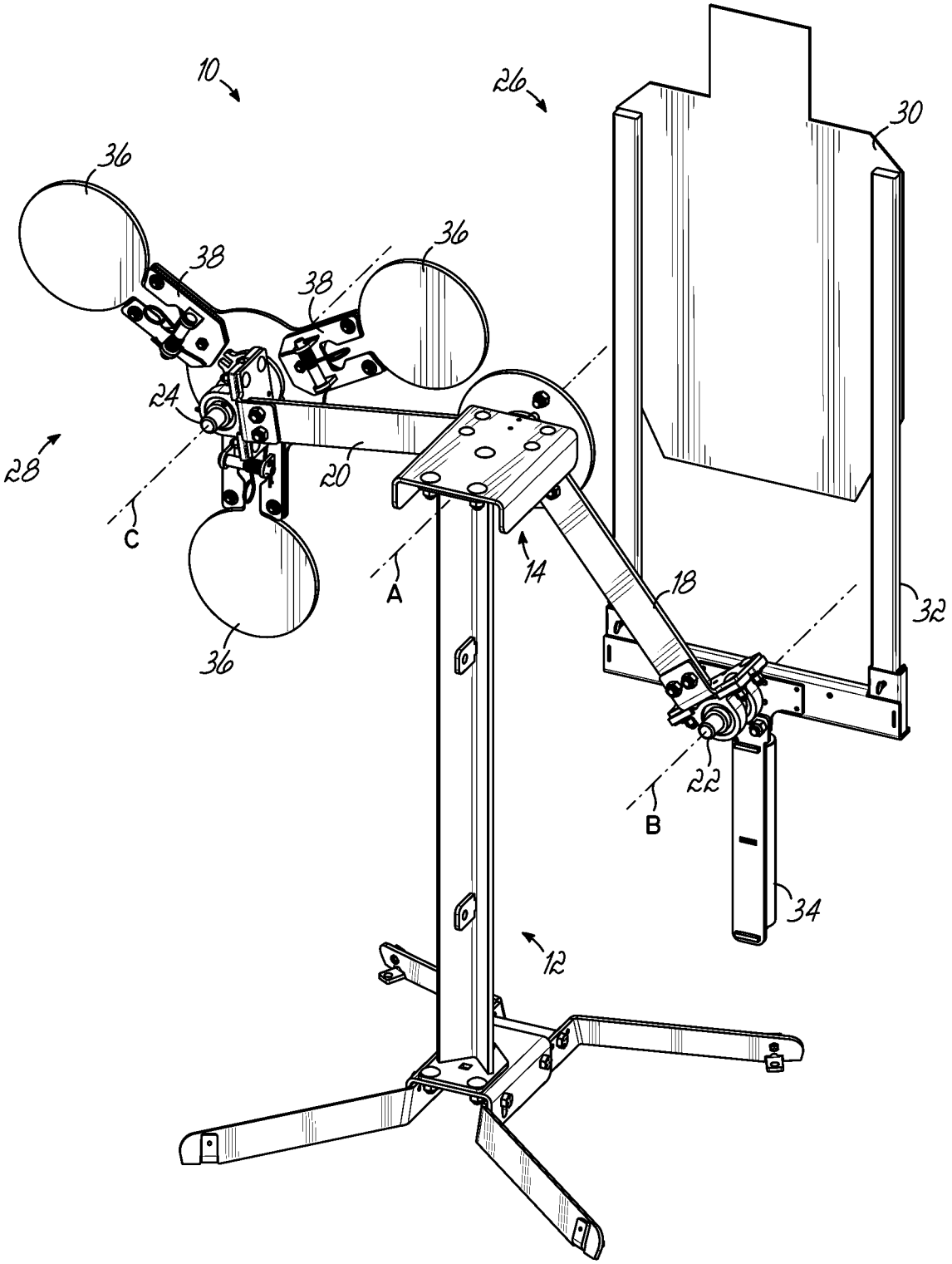
FIG. 2 is a rear pictorial view thereof.
Figure 3:
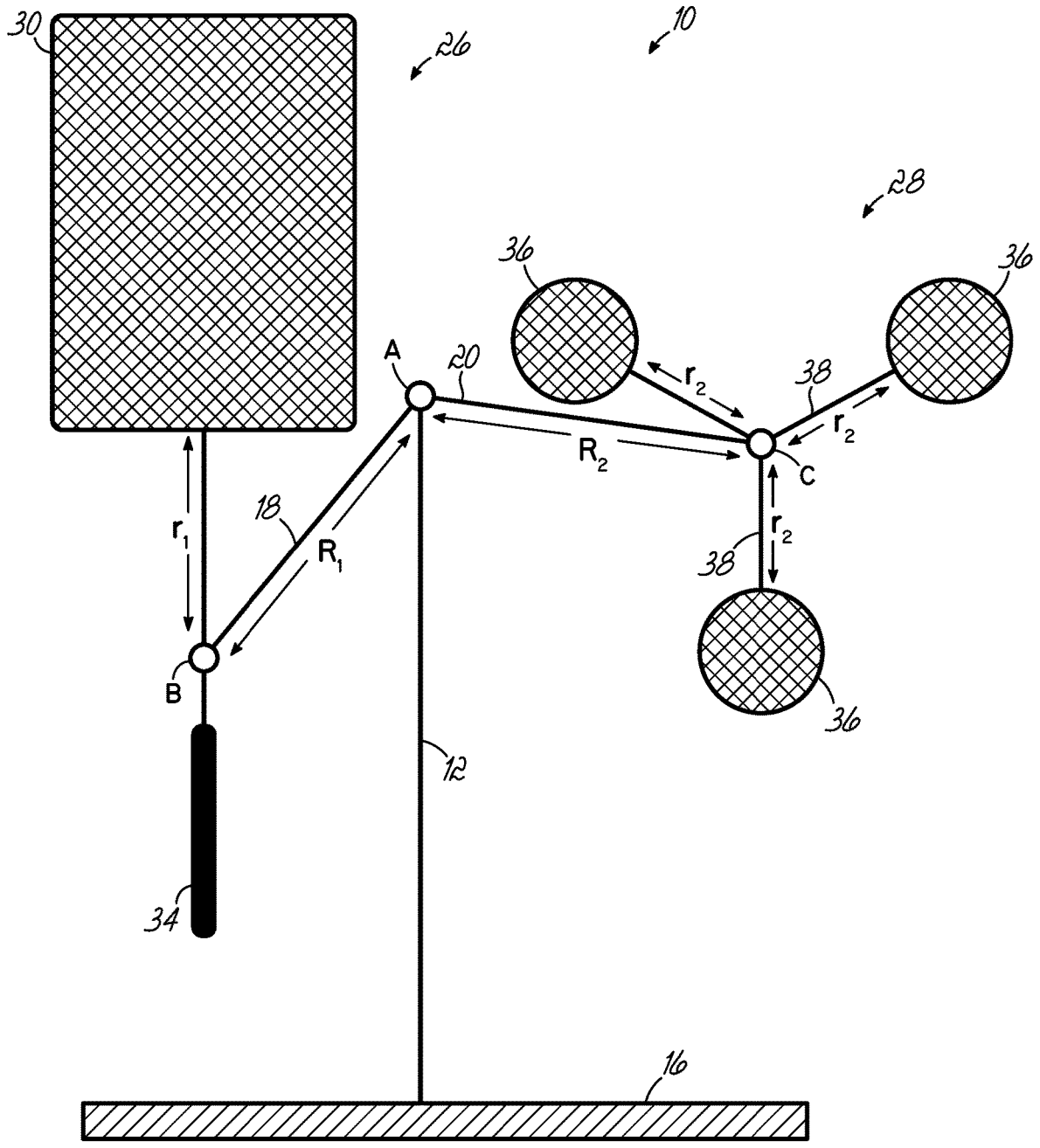
FIG. 3 is a front view schematic representation thereof illustrating the radii of certain members relative to their axes of rotation.

Referring first to FIGS. 1, 2, and 3, therein are shown pictorial views (FIGS. 1 and 2) and a front schematic illustration (FIG. 3) of a swinging target device 10 according to one embodiment of the present invention. The device 10 includes a stand 12 that supports a first pivot mechanism 14 that provides a primary, fixed pivot axis A at a position elevated vertically above the ground 16. Radially spaced from the first pivot 14 on radial arms 18, 20 are secondary pivot mechanisms 22, 24 that provide first and second secondary pivot axes B, C that rotate relative to the primary pivot axis A. Arms 18, 20 are fixed relative to one another; consequently, both arms 18, 20 pivot about pivot axis A as a solid body. All of the pivot mechanisms 14, 22, 24 described herein can be any suitable known device or assembly, for example one using a permanently lubricated, self-lubricating, or sealed bearing.

A first target assembly 26 is mounted to the first arm 18 to pivot at the first secondary pivot axis B. A second target assembly 28 is mounted to the second arm 20 to pivot at the second secondary pivot axis C. The first and second target assemblies 26, 28 can be substantially the same or, as illustrated, different. Whether substantially the same or different, the masses of the first and second target assemblies 26, 28 with each arm 18, 20 can be substantially the same, so that they are substantially balanced, or can be different. The first target assembly 26 may 26 may include, for example, a counterweighted inverted pendulum assembly having a target panel 30 (such as a shape of perforable cardboard or similar material held in a frame 32) counterbalanced by a weight 34 that hangs below the pivot mechanism 22 and has at least a slightly greater mass than the panel 30 and frame 32 to keep the target panel 30 generally above the pivot axis B while allowing it to swing through a significant arc, as illustrated. The greater the radius $r_1$ of the panel 30 relative to the pivot axis B, the greater the movement of the target panel 30.

The second target assembly 28 may include, for example, a "star" of displaceable target plates 36 replaceably mounted on secondary arms 38 to rotate or swing about the second secondary pivot mechanism 24, as illustrated. The radii $r_2$ of the secondary arms 38 can be the same, as illustrated, or different.

The main radial arms 18, 20 may extend radially from the first pivot mechanism 14 and primary pivot axis A at any angle relative to each other between zero and 180 degrees. That is, both the first and second secondary pivot axes B, C can be on the same radius or radial arm extending from the primary pivot axis A, they may be opposite each other, they can be placed at some in-between angle relative to each other, or, if more than two arms and secondary pivot axes are used, they can be evenly or unevenly angularly spaced around the primary pivot axis A. Likewise, the radius/length $R_1$, $R_2$ of each arm 18, 20 (i.e., the radial distance between the primary pivot axis A and first and second secondary pivot axes B, C) can be the same or different.

FIG. 3 schematically illustrates the relationship between the three pivot axes A, B, and C. The primary pivot axis A is supported at a fixed position above the ground by the stand 12. The pair of arms 18, 20, that are at a fixed angular relationship to each other, extend radially from the primary pivot axis A and rotate together. Thus, the first and second secondary pivot axes B, C move together in unison around the primary pivot axis A. Target assemblies 26, 28 are mounted to rotate on the first and second secondary pivot axes B, C. In the illustrated example, the first target assembly 26 is in the form of a counterweighted panel that can be, for example, a replaceable paper or cardboard sheet 30 supported in a frame 32 above the first secondary pivot axis B. The counterweight 34 should be slightly heaver than the target panel 30 and frame 32 so that it stays generally upright, but will swing freely about the first secondary pivot axis B, while also further being moved up and down vertically and side to side horizontally by the changing position of the first secondary pivot axis B. The longer the radius of each swinging/rotating target assembly relative to the primary pivot axis A, the greater the movement of the various targets. This, however, has a practical limit in terms of size, weight, and cost.

Figure 4:
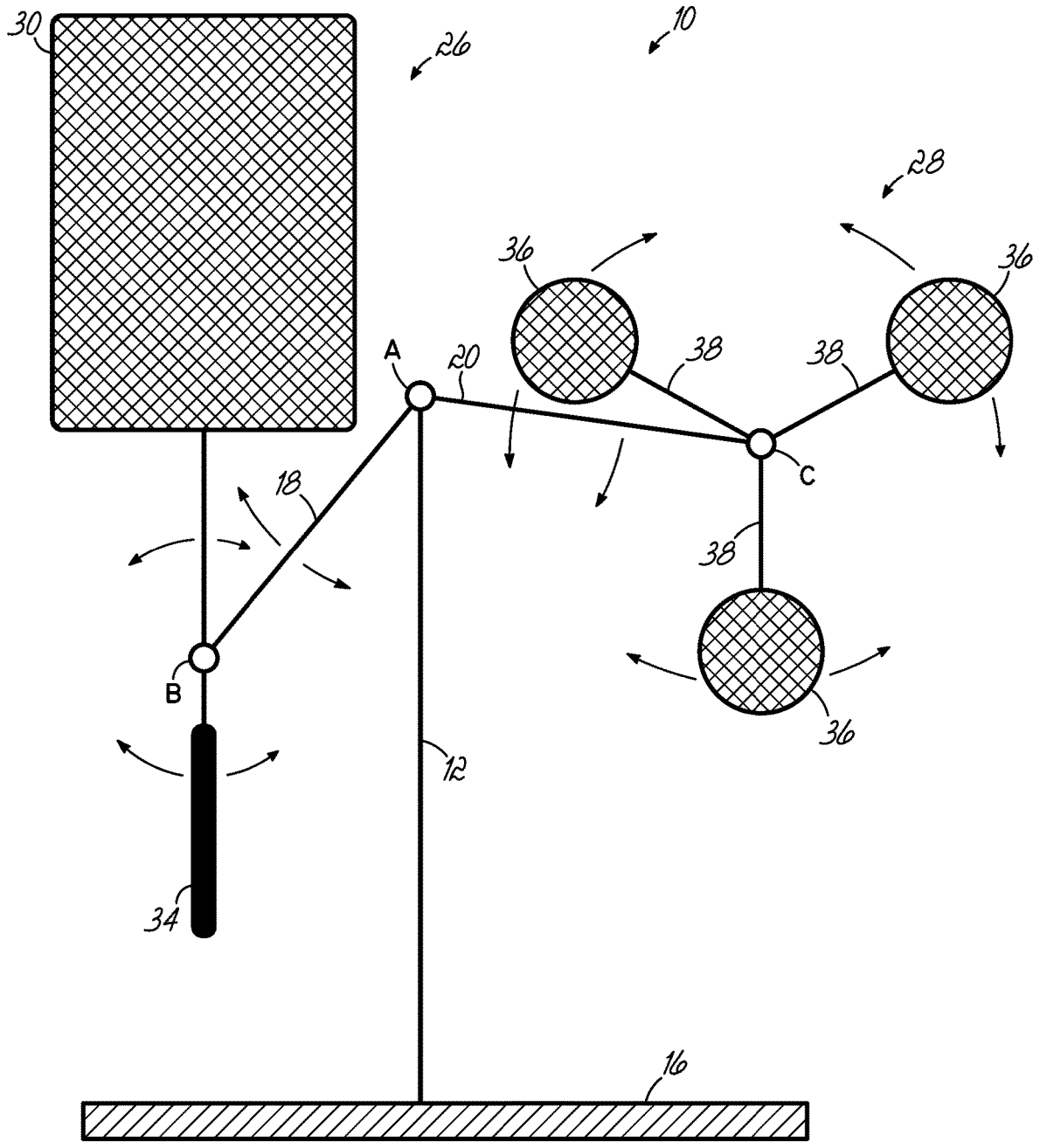
FIG. 4 is a similar schematic representation illustrating the rotational directions of those members relative to their axes of rotation.

FIG. 4 schematically illustrates the rotational movement of the various components relative to primary pivot axis A and secondary pivot axes B and C.

Figure 5:
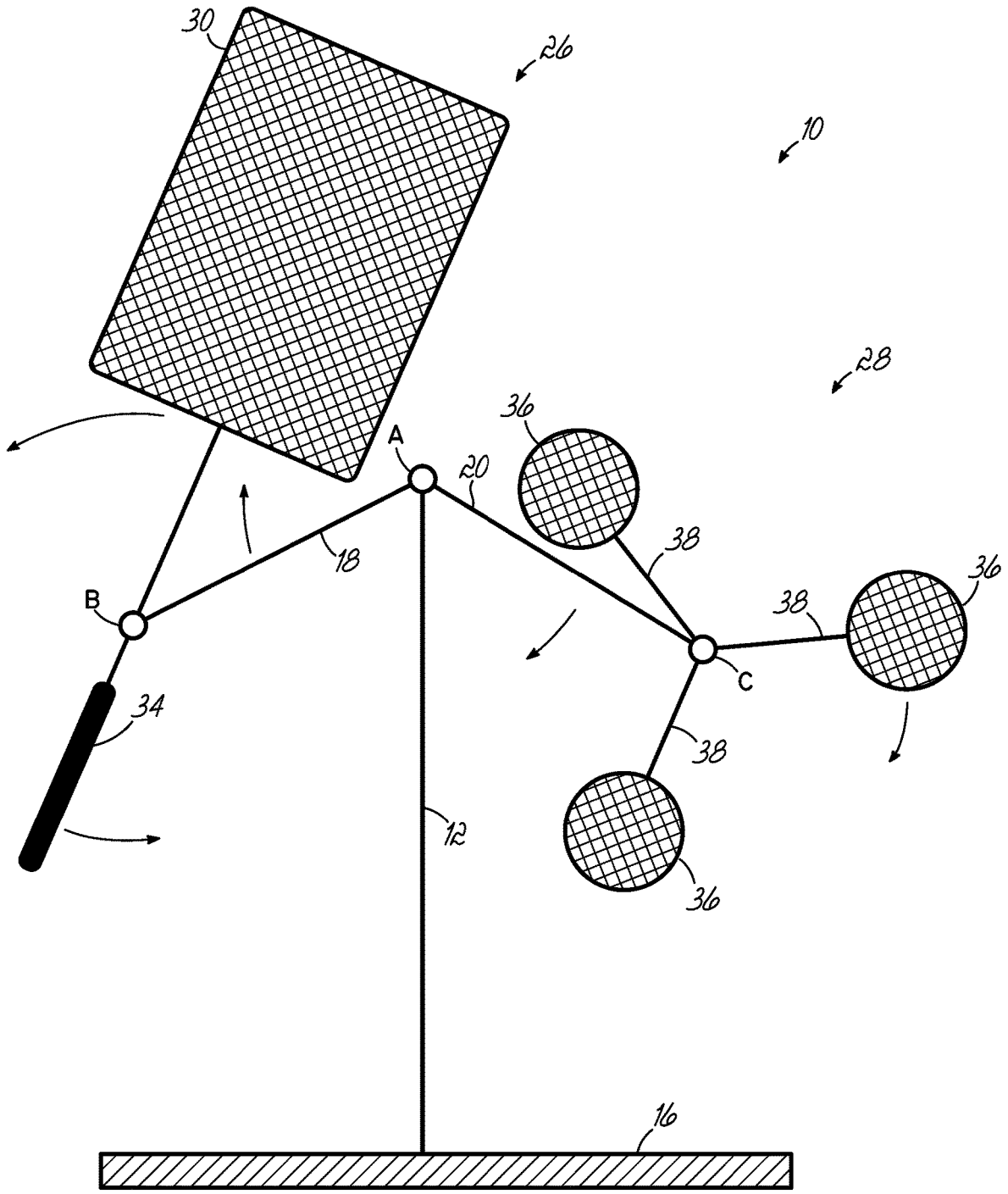
FIG. 5 is a similar schematic representation showing example rotated positions of certain target elements.

FIG. 5 illustrates an example location and movement of the various components of the device 10 (relative to that illustrated in FIG. 3) when set into motion and propelled by the force of gravity. The first target panel 30 moves both up and down and side to side as it swings about the first secondary pivot axis B. The target plates rotate, changing both vertical and horizontal position as they rotate about the second secondary axis C. However, the direction, speed, and distance of this movement is compounded because both moving, secondary pivot axes B and C are swinging in an arc relative to the fixed, primary pivot axis A.

A primary center of mass of the arms 18, 20 and first and second target assemblies 26, 28 (at least initially) mounted to the primary pivot mechanism 14 can be coaxial with the primary pivot axis A or may eccentric, the former creating a "wheel" effect and the latter creating a pendular effect. That is, they can be balanced or can be unbalanced (or made to be imbalanced during use) so that the arms 18, 20 swing together like a pendulum. This primary center of mass can be changed while the target device 10 is being used, such as by shooting off one or more of the detachable target plates 36.

Figure 6:
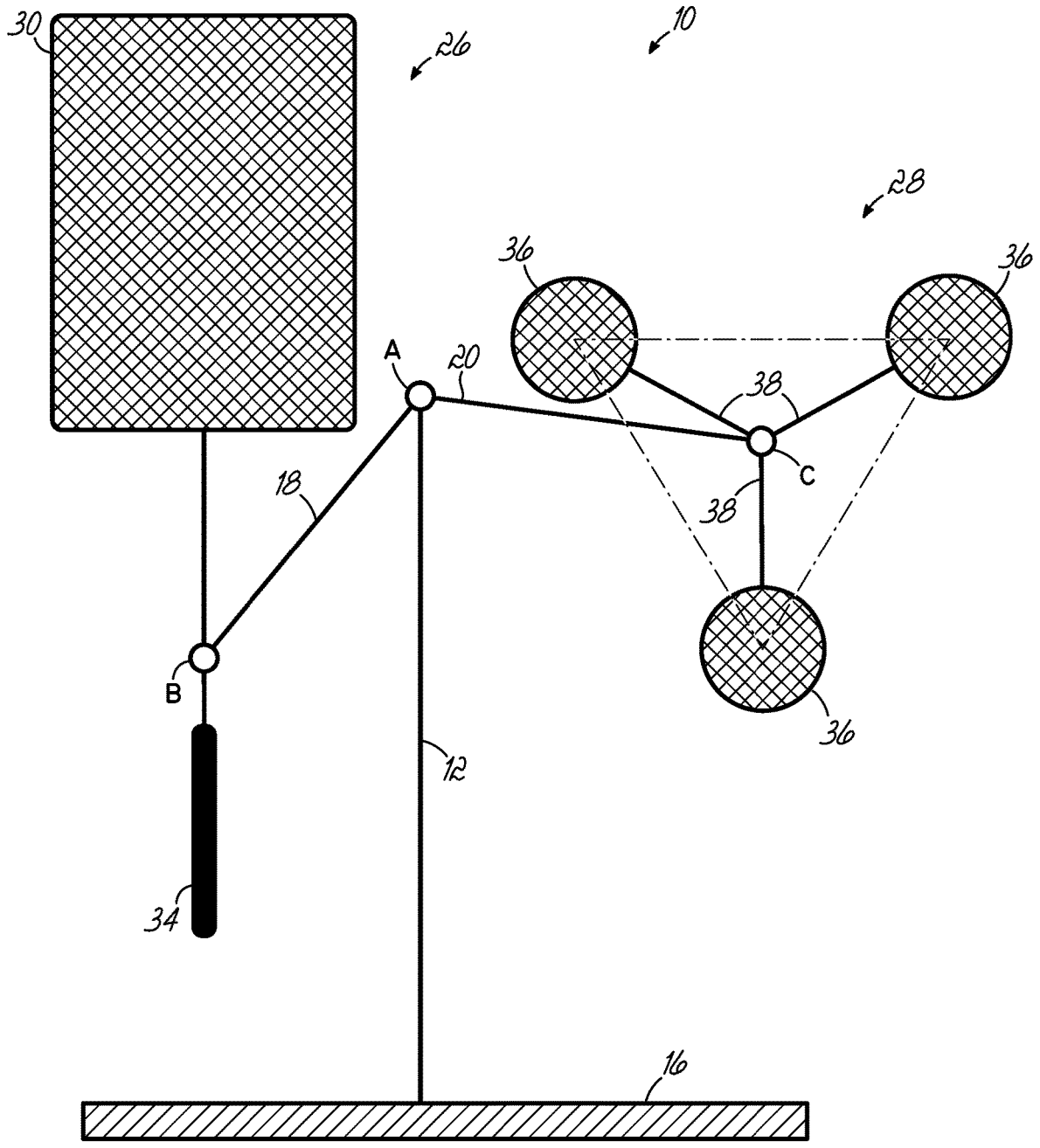
FIG. 6 is a similar schematic representation illustrating the location of a first center of mass.

FIG. 6 illustrates the center of mass of the example second target assembly 28 with three target plates 36 of substantially similar mass mounted to rotate about the second secondary pivot axis C on secondary arms 38 of substantially similar length. In this condition, the assembly 28 rotates as a substantially balanced wheel with its center of mass substantially coaxial with the second secondary pivot axis C.

Figure 7:
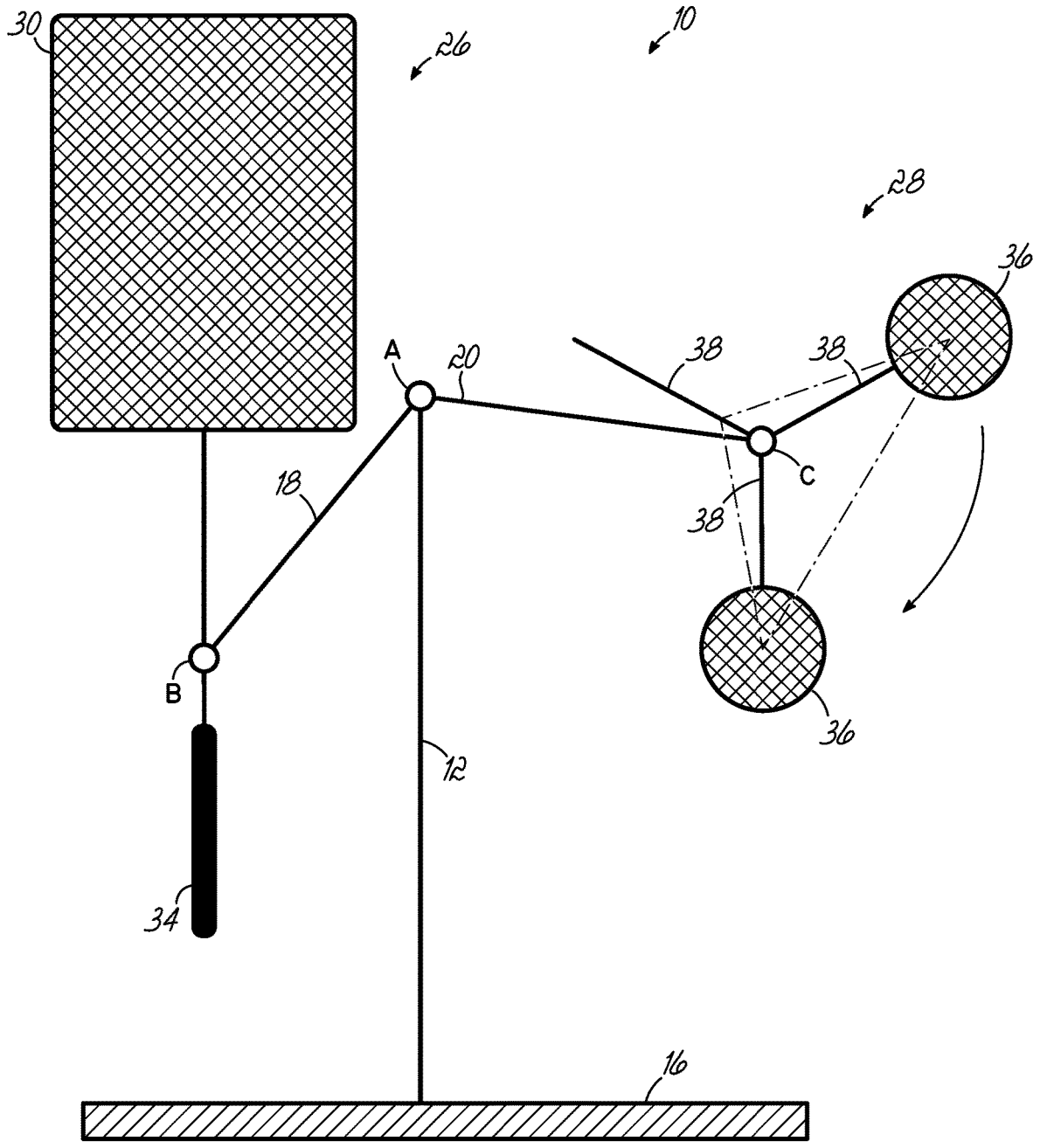
FIG. 7 is a schematic representation illustrating the location of a changed center of mass (relative to that illustrated in FIG. 6)

FIG. 7 illustrates the change in center of mass when one of the target plates 36 is shot off and thus removed. The center of mass of the secondary target assembly 28 becomes eccentric to the second secondary pivot axis C and causes the modified assembly to swing (as illustrated by arrow) as a pendulum relative to the second secondary pivot axis C. The momentum of this pendulum applies force varying in both speed and direction to the radial arm 20, which itself is part of a pendulum swinging about the fixed primary pivot axis A.

Figure 8:
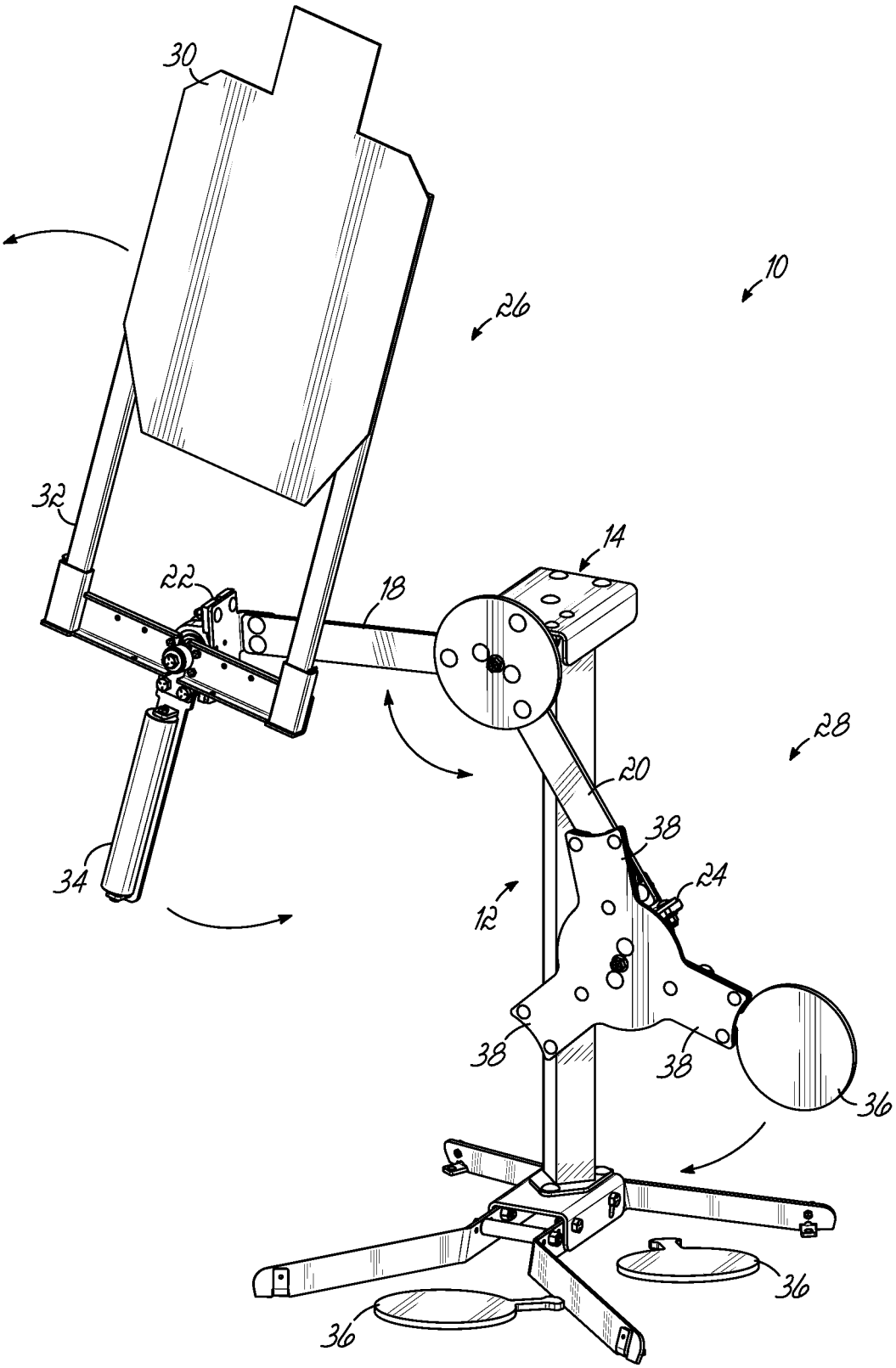
FIG. 8 is a pictorial view of the device showing two targets plates that have been shot away, resulting in a changed center of mass.

FIG. 8 shows pictorially the second target assembly 28 with one remaining target plate 36 acting as a single pendulum. When the last remaining target plate 36 is shot off (not shown), the second arm 20 will no longer have an eccentric center of mass and will be affected in substantially the same way as when all the target plates are in place, except with less mass.

The dynamic energy (movement) of eccentric masses radially spaced about a pivot axis includes not only speed and direction, but has momentum, which compounds the effects of the multiple pendular movements and makes the speed, placement, direction, and movement of the various targets seem even more erratic and unpredictable. While an engineer or physicist could calculate and predict the target movements in any particular condition, the conditions change when the centers of mass change (target plates are shot off) and further depend on exactly when the masses change (i.e., the location, direction, and velocity of each swinging mass at the moment when the change takes effect). This makes predicting the location (as well and speed and direction) of each target at any given moment particularly challenging.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A swinging target device, comprising:

a stand, an arm having a first arm portion and a second arm portion, the arm pivoted to the stand between the first and second arm portions of the arm for pivoting movement about a primary pivot axis, the first arm portion extending from the primary pivot axis to a first end of the arm and the second arm portion extending from the primary pivot axis to a second end of the arm, a first target assembly pivoted to the first end of the arm for pivoting movement about a first secondary pivot axis, wherein the first target assembly comprises:

a target frame extending upwardly from the first secondary pivot axis, a target panel mounted to the target frame, and a counterweight attached to the target frame and extending downwardly from the first secondary pivot axis, wherein the counterweight has a greater mass than the target panel and the target frame to keep the target panel above the first secondary pivot axis while allowing it to swing along an arc, wherein the target panel is paper or cardboard, and wherein the target frame comprises a pair of parallel and spaced apart support members on which the target panel is arranged; and a second target assembly pivoted to the second end of the arm for pivoting movement about a second secondary pivot axis.

2. The target device of claim 1, wherein the first target assembly is configured to oscillate +/−90 degrees from vertical and the second target assembly is configured to rotate through 360 degrees.

3. The target device of claim 1, wherein:

the second target assembly comprises an arm assembly having at least three arms projecting radially outwardly from the second secondary pivot axis, and a target plate removably attached to a free end of each of the arms, the target plates configured to detach from respective arms when struck by a projectile.

4. The target device of claim 1, wherein the first and second arm portions form an angle of 0 degrees to 180 degrees relative to one another.

5. The target device of claim 1, wherein the first arm portion has a first length and the second arm portion has a second length, and wherein the first and second lengths are the same.

6. The target device of claim 1, wherein the first arm portion has a first length and the second arm portion has a second length, and wherein the first and second lengths are different.

7. The target device of claim 1, wherein a combined center of gravity of the arm and the first and second target assemblies is coaxial with the primary pivot axis.

8. The target device of claim 1, wherein a combined center of gravity of the arm and the first and second target assemblies is not coaxial with the primary pivot axis.

9. The target device of claim 1, wherein at least one of the first and second target assemblies has a variable mass that changes when at least a portion of the one of the first and second target assemblies is struck by a projectile.

10. The target device of claim 9, wherein when the mass of the one of the target assemblies changes, a center of gravity of the one of the target assemblies also changes.

11. A swinging target device, comprising:

a stand, an arm having a first end and a second end, the arm pivoted to the stand between the first and second ends of the arm for pivoting movement about a primary pivot axis, a first target assembly pivoted to the first end of the arm for pivoting movement about a first secondary pivot axis, and a second target assembly pivoted to the second end of the arm for pivoting movement about a second secondary pivot axis, the first target assembly comprising a target frame extending upwardly from the first secondary pivot axis, a target panel mounted to the target frame, and a counterweight attached to the target frame and extending downwardly from the first secondary pivot axis, the first target assembly configured to oscillate +/−90 degrees from vertical, wherein the counterweight has a greater mass than the target panel and the target frame to keep the target panel above the first secondary pivot axis while allowing it to swing along an arc, wherein the target panel is paper or cardboard, and wherein the target frame comprises a pair of parallel and spaced apart support members on which the target panel is arranged; and the second target assembly comprising an arm assembly having at least three arms projecting radially outwardly from the second secondary pivot axis, and a target plate removably attached to a free end of each of the arms, the target plates configured to detach from respective arms when struck by a projectile, the second target assembly configured to rotate through 360 degrees.

* * * * *